US008366849B2

(12) United States Patent
Buchi et al.

(10) Patent No.: US 8,366,849 B2
(45) Date of Patent: Feb. 5, 2013

(54) METHOD FOR LINING A CONTAINER AND LINING OF A CONTAINER

(75) Inventors: Moritz Buchi, Sachseln (CH); Josef Von Rotz, Kerns (CH)

(73) Assignee: Sika Technology AG, Baar (CH)

( * ) Notice: Subject to any disclaimer, the term of this patent is extended or adjusted under 35 U.S.C. 154(b) by 710 days.

(21) Appl. No.: 11/887,819

(22) PCT Filed: Apr. 7, 2006

(86) PCT No.: PCT/EP2006/003170

§ 371 (c)(1),
(2), (4) Date: Dec. 29, 2008

(87) PCT Pub. No.: WO2006/105978

PCT Pub. Date: Oct. 12, 2006

(65) Prior Publication Data

US 2009/0139633 A1 Jun. 4, 2009

(30) Foreign Application Priority Data

Apr. 7, 2005 (DE) ..... 20 2005 005 522

(51) Int. Cl.

| | |
|---|---|
| ***A41H 37/00*** | (2006.01) |
| ***A44B 19/00*** | (2006.01) |
| ***E04B 2/00*** | (2006.01) |
| ***E04F 13/00*** | (2006.01) |
| ***B32B 7/04*** | (2006.01) |
| ***B32B 37/00*** | (2006.01) |
| ***B29C 65/00*** | (2006.01) |
| ***B65D 6/00*** | (2006.01) |
| ***B65D 8/00*** | (2006.01) |
| ***B65D 1/40*** | (2006.01) |
| ***B65D 3/22*** | (2006.01) |
| ***B65D 6/14*** | (2006.01) |
| ***B65D 8/04*** | (2006.01) |
| ***B65D 90/02*** | (2006.01) |

(52) U.S. Cl. ..... 156/66; 156/71; 156/91; 220/4.12; 220/495.01; 220/62.11; 220/694

(58) Field of Classification Search ..... 156/60, 156/66, 71, 72, 87, 90, 91, 94, 145, 242, 156/244.11, 246, 250, 278, 293, 297, 299, 156/308.2, 308.4, 309.6; 220/4.01, 4.12, 220/4.13, 4.16, 4.17, 495.01, 495.03, 495.04, 220/495.06, 694; 4/496, 580, 655
See application file for complete search history.

(56) References Cited

U.S. PATENT DOCUMENTS 3,519,164 A 7/1970 Lehto
5,191,007 A * 3/1993 Zelazny et al. ..... 524/336
(Continued)

FOREIGN PATENT DOCUMENTS

DE 33 20 867 A1 12/1984
EP 0 926 304 A2 6/1999
(Continued)

OTHER PUBLICATIONS

Japanese Office Action dated May 18, 2010 in JP Appln. No. 2008-504693 w/translation.

*Primary Examiner* — Philip Tucker
*Assistant Examiner* — Brian R Slawski
(74) *Attorney, Agent, or Firm* — Oliff & Berridge, PLC

(57) ABSTRACT

The invention relates to a method for lining a container, especially a reservoir, a tank or a basin in a water-tight manner. In order to avoid possible leakages and/or contaminations, the walls of the large container are provided with hook-and-loop-type fastening elements. Sealing webs are attached to these fastening elements by means of fastening elements.

16 Claims, 1 Drawing Sheet

U.S. PATENT DOCUMENTS

| | | | | |
|---|---|---|---|---|
| 5,282,282 | A | 2/1994 | Shehan et al. | |
| 5,282,550 | A * | 2/1994 | Coleman | 222/105 |
| 6,347,886 | B1 * | 2/2002 | Willemstyn | 383/121 |
| 2002/0029441 | A1 * | 3/2002 | Shepard et al. | 24/442 |
| 2004/0034914 | A1 * | 2/2004 | Gross | 4/496 |
| 2006/0175007 | A1 * | 8/2006 | Tanghe | 156/308.4 |

FOREIGN PATENT DOCUMENTS

| | | | |
|---|---|---|---|
| EP | 1 022 412 | A1 | 7/2000 |
| EP | 1 426 528 | A1 | 6/2004 |
| JP | S47-30106 | | 8/1972 |
| JP | A-11-36385 | | 2/1998 |
| WO | WO 9845554 | A1 * | 10/1998 |

* cited by examiner

METHOD FOR LINING A CONTAINER AND LINING OF A CONTAINER

CROSS REFERENCE TO RELATED APPLICATIONS

This application is a national stage filing under section 371 of International Application No. PCT/EP2006/003170, filed Apr. 7, 2006, and claims priority to German Patent Application No. DE 20 2005 0055 22.0, filed Apr. 7, 2005.

TECHNICAL FIELD

The present invention relates to a method for lining a container according to the precharacterizing clause of claim 1, and to a lining according to the precharacterizing clause of the independent device claim

PRIOR ART

Containers for receiving liquids are used, inter alia, as water reservoirs, in particular drinking water reservoirs. It goes without saying that, in the case of such installations, the stored liquid must be protected from contaminations of all kinds in a reliable way. For this purpose, the walls of these water reservoirs are generally provided with a particularly suitable protective coating or lined with plastic material. Unfortunately, when a protective coating is used, it is not possible to avoid the stored water being contaminated or to avoid water flowing out of the reservoir if there is a crack in the wall or the masonry is suffering the effects of ageing. This of course applies to all kinds of liquid reservoirs, such as swimming pools and tanks for chemicals or foodstuffs.

It has therefore also been proposed, for example in EP 1 002 412, to use a protective covering of plastic that is provided with reinforcing fibers. Over the course of time, such coverings come away again from the underlying surface because of the lack of moisture exchange. In the case of large containers with such protective coverings, renewal is disproportionately laborious.

EP 1 426 528 discloses a method of lining a water reservoir with plastic sheets. This provides that the masonry of the reservoir is covered with a spacer in the form of nubbed films, cardboard or a knitted fabric and that this spacer is coated on the water side with a layer of plastic that cures with a waterproof effect. Unfortunately, the fitting of such a lining is extremely laborious and it is only with very great difficulty that such a lining can be provided in a uniform and homogenous way in regions that slope in an overhanging manner.

It is also known to lay out a nonwoven fabric and fasten it with nails to the underlying surface. Sheets of plastic are fastened to this nonwoven fabric by using nails to fasten the said sheets along their edge region to the underlying surface. The damaged areas/holes produced by the nails in the sheets of plastic are closed off again with a waterproof effect by lap welding of the sheet of plastic. Unfortunately, the fitting of such a lining also proves to be laborious.

SUMMARY OF THE INVENTION

An object of the present invention is therefore to provide a method for lining a container with the aid of waterproof sheets of plastic that are easy to fit and easy to renew.

It is in particular an object of the present invention to provide a waterproof lining for containers that does not have the disadvantages of the known linings and can also be fastened in an easy way to portions of the container that slope in an overhanging manner.

This object is achieved according to the invention by a method according to the first claim and a lining with the features of the independent device claim.

In particular, in the case of this method, the inner side of the container is provided with bands and/or strips similar to hook-and-loop fasteners, to which a sealing sheet of plastic is applied by means of fastening elements. It goes without saying that it does not matter whether the bands similar to hook-and-loop fasteners have hooks which interact with loops of the fastening elements of the sealing sheet, or whether these bands are provided with loops which interact with hooks of the fastening elements of the sealing sheet.

The use of elements that attach themselves to one another like Velcro® is advantageous. The sealing sheets that are fixed in this way to the underlying surface, i.e. to the inner side of the container, are advantageously connected to one another in an overlapping manner, in particular welded, in order to form a waterproof lining. The sealing sheets advantageously have as fastening elements a nonwoven lamination over their full surface area. It goes without saying that this lamination, acting similar to a hook-and-loop fastener, may also be only partially applied.

The advantages of the method according to the invention and the lining according to the invention are immediately evident to a person skilled in the art and can be seen in particular in the extremely easy fitting, whereby the fitting costs can be lowered, and in the further improvement of the long-term reliability. This structure is movable with respect to the underlying surface and does not suffer any damage if cracks form or there are other movements of the container. It has proven to be particularly advantageous that an air-permeable intermediate space is created between the sealing sheet and the underlying surface or container wall, which is advantageous for moisture exchange.

The present invention is suitable in particular for lining large containers.

Further advantageous refinements of the invention emerge from the subclaims.

BRIEF DESCRIPTION OF THE DRAWINGS

Exemplary embodiments of the invention are explained in more detail below on the basis of the drawings. In the various figures, the same elements are provided with the same designations.

In the drawings.

Only the elements that are essential for the direct understanding of the invention are shown.

WAYS OF IMPLEMENTING THE INVENTION

Figure 1:
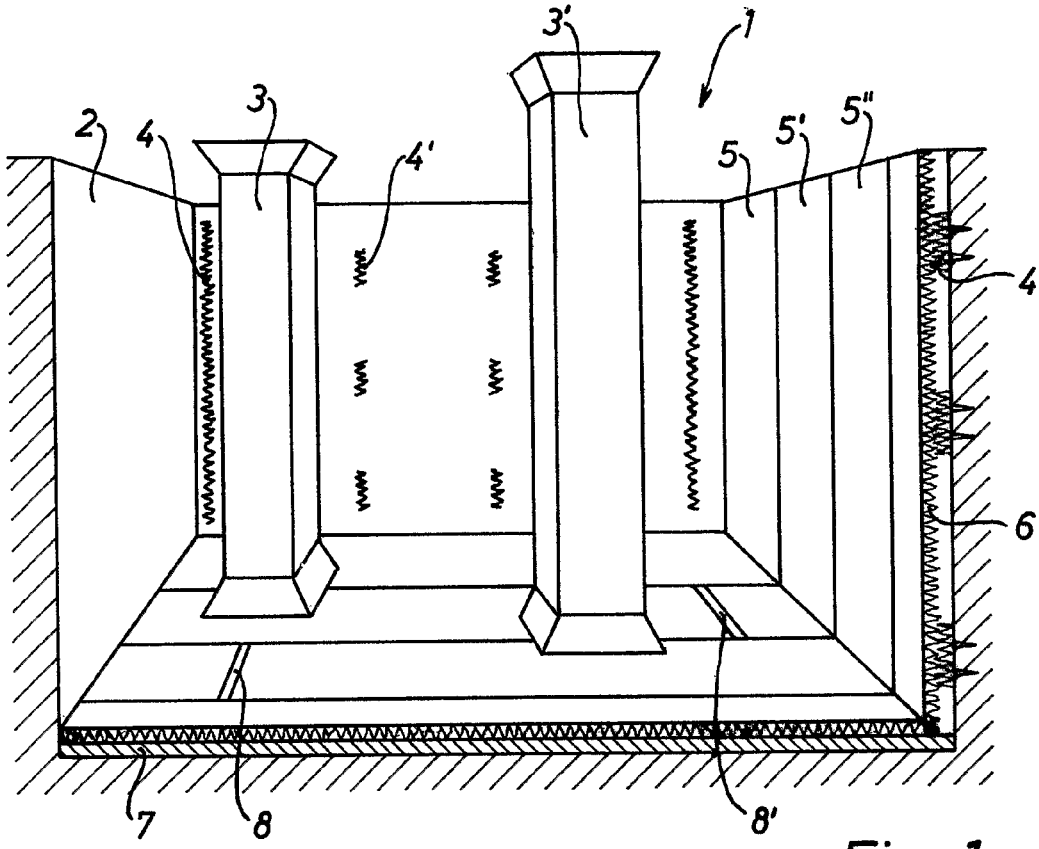
FIG. 1 shows a schematic representation of a three-dimensional view of a container with a section through a structure according to the invention.

FIG. 1 shows a container 1, in particular a large container such as a water reservoir, in a spatial representation. This water reservoir has walls 2, which in the present case are produced from unfinished concrete. Columns 3 support a top panel. On the rear side, fastening elements 4 similar to hook-and-loop fasteners can be seen and these are fastened to the unfinished concrete of the walls 2 before a sealing sheet 5 is applied. The sealing sheet may in this case consist of any desired materials. According to the invention, the sealing sheets 5 have fastening elements 6, which interact with the fastening elements 4 similar to hook-and-loop fasteners. The fastening element 6 is advantageously a nonwoven lamination, which is at least partially arranged on the sealing sheet. The fastening element 6 may, however, also be some other element similar to a hook-and-loop fastener or a combination of a nonwoven lamination and an element similar to a hook-and-loop fastener. Over the unfinished concrete, in particular on the bottom side, there may be provided an insulating layer 7 or an additional drainage layer, on which the sealing sheets 5 are laid.

During the fitting of the lining according to the invention, in a first step hook-and-loop bands or hook-and-loop strips are fastened on the unfinished concrete with the aid of fastening elements, in particular hammered rivets. In the region of the miter joints, the hook-and-loop bands 4 are preferably fitted over the entire length of the miter joint, while it is sufficient in the wall region to fasten hook-and-loop bands 4 only at selected points. In a second fitting step, a first sealing sheet of plastic is fastened, i.e. by hooks and loops, to the vertically extending hook-and-loop bands. The following sheets are laid in the same way on the wall 2 with an overlap of several cm, for example about 6 cm, and subsequently welded to one another from the top downwards. In the region of the miter joints, the sealing sheets 5 are bent in the cold state and laid continuously, without cutting. Consequently, only the last wall sheet in the longitudinal direction needs to be cut. All the sheets can be welded to one another with an automatic welder of a known type. Advantageously, a Leister X84 Reservoir automatic welder is used and the welding is performed with flush seams.

Once the wall surfaces 2 have been laid, edge finishing rails 11 are mounted on the top side. The individual wall sheets 5 may then be cut along these edge finishing rails 11 and sealed with a suitable sealant 12, in particular mastic, with respect to the unfinished-concrete wall 2. Venting valves 13 are only welded on after finishing with the rails, in order that they can be fitted all around at the same height.

The wall sheets 5 are marked on the bottom side exactly at the desired height and precisely cut back, advantageously with a laser device. After that, adjoining sheets 5' are measured and bent in the cold state. The adjoining sheets 5' are likewise fastened to the hook-and-loop strips 4 and subsequently longitudinally welded with the automatic welder. The sheets are cut off straight across in the region of the miter joints and are overwelded with a plastic band 8 on the horizontal surface. Similarly, the vertical welding points are subsequently welded with a hand-held welder. Similarly, the columns 3 can be lined. Only when the measuring for the columns 3 has been completed is a sample tested to check whether the sealing sheets have been correctly cut to size. The sealing sheets are warmed with a gas torch in the region of the edges and folded so as to fit exactly. At a distance of approximately 1.5 m from each of the outer two edges, a loop is welded on. The preformed sheet is then placed around the column 3 and lashed tight with tensioning straps. In this way, the overlapping region can be welded with the automatic welder. After that, the tensioning straps and the fastening loops are removed again.

For the bottom surface, the adjoining sheets 5' can be laid and/or cut without any overlap. The butt edge of the sheets may be overwelded with a plastic band, the band advantageously first being welded onto the adjoining sheet 5' and subsequently welded onto the bottom sheet. Similarly, the adjoining seams may be welded together on the wall with a band and with the aid of a hand-held welder or an automatic welder. The same is intended for the lining of the column bases.

Figure 2:
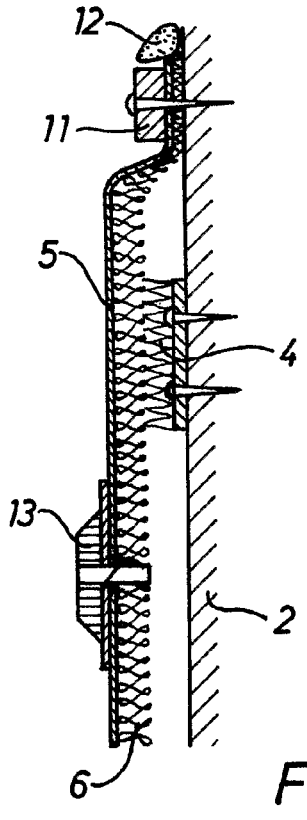
FIG. 2 shows a schematic representation of a sectional view through a lining according to the invention.

The structure of the lining according to the invention can be seen from FIG. 2. Here, in a first step, a hook-and-loop band or hook-and-loop strip 4 is fastened to the unfinished-concrete wall 2 with the aid of fastening elements, in particular hammered rivets. The sealing sheets 5, which are laminated with a nonwoven here, are attached with the hook-and-loop bands 4, in order to achieve first fixing of the sealing sheets to the container wall 2. With an edge finishing rail 11, the sealing sheet 5 is pressed against the wall 2. The intermediate space between the sealing sheet 5 and the concrete wall 2 is closed in an airtight manner with sealing material 12. Subsequently fitted venting valves 13 allow pressure equalization between the lined chamber and the intermediate space. It goes without saying that, in regions in which installed parts made of metal, such as steps or feeding chutes, are placed on the lined bottom, an additional piece of nonwoven fabric or foam can be placed over the sealing sheets and in turn be covered with a covering film and welded to the sealing sheet.

Although the lining method according to the invention has only been described here with respect to a water reservoir, by way of example, it goes without saying that this method can also be used in any other areas desired, and in particular for the lining of tanks for foodstuffs (for example wine or oil) or chemicals, swimming pools, landfill sites and the like.

The invention claimed is:

1. A method for lining a container with a waterproof layer of plastic, the method comprising:

fastening at least one first fastening element to an inner side of the container; and fastening at least one sealing sheet of plastic, which has at least partially a non-woven lamination, to the first fastening element with the non-woven lamination of the sealing sheet, which acts as a second fastening element, wherein the non-woven lamination covers a full surface area of the sealing sheet.

2. The method as claimed in claim 1, wherein a number of sealing sheets are arranged, and the sealing sheets are subsequently connected to one another with a waterproof effect.

3. The method as claimed in claim 2, wherein the sealing sheets are welded in an overlapping manner and with flush seams.

4. The method as claimed in claim 2, wherein the sealing sheets are provided, in a region of an upper cut edge of the container, with an edge finishing rail.

5. The method as claimed in claim 2, wherein the sealing sheets are provided with venting valves.

6. A lining with a waterproof layer of plastic for a container, the lining comprising:

at least one first fastening element provided on an inner side of the container; and at least one sealing sheet of plastic, which has at least partially a non-woven lamination, fastened to the first fastening element with the non-woven lamination of the sealing sheet, which acts as a second fastening element, wherein the non-woven lamination covers a full surface area of the sealing sheet.

7. The lining as claimed in claim 6, wherein a number of sealing sheets are arranged, and the sealing sheets are subsequently connected to one another with a waterproof effect.

8. The lining as claimed in claim 7, wherein the sealing sheets are welded in an overlapping manner and with flush seams.

9. The lining as claimed in claim 7, wherein the sealing sheets are provided, in a region of an upper cut edge of the container, with an edge finishing rail.

10. The lining as claimed in claim 7, wherein the sealing sheets are provided with venting valves.

11. The method as claimed in claim 1, wherein the non-woven lamination covers a full surface area of every portion of the sealing sheet.

12. The lining as claimed in claim 6, wherein the non-woven lamination covers a full surface area of every portion of the sealing sheet.

13. The method as claimed in claim 1, wherein the container is a tank or a basin.

14. The lining as claimed in claim 6, wherein the container is a tank or a basin.

15. The method as claimed in claim 1, wherein the first fastening element is a hook-and-loop fastener.

16. The lining as claimed in claim 6, wherein the first fastening element is a hook-and-loop fastener.

* * * * *

UNITED STATES PATENT AND TRADEMARK OFFICE

CERTIFICATE OF CORRECTION

PATENT NO. : 8,366,849 B2
APPLICATION NO. : 11/887819
DATED : February 5, 2013
INVENTOR(S) : Buchi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1,272 days.

Signed and Sealed this
Eleventh Day of November, 2014

Michelle K. Lee

Michelle K. Lee
*Deputy Director of the United States Patent and Trademark Office*